US009039242B2

(12) United States Patent
Choi et al.

(10) Patent No.: US 9,039,242 B2
(45) Date of Patent: May 26, 2015

(54) LIGHTING DEVICE

(71) Applicant: LG Innotek Co., Ltd., Seoul (KR)

(72) Inventors: Tae Young Choi, Seoul (KR); Won Jin Son, Seoul (KR); Dong Nyung Lim, Seoul (KR); Jung Ha Hwang, Seoul (KR); Seung Yeon Lee, Seoul (KR); Cheon Joo Kim, Seoul (KR); Sung Ho Kim, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/285,417

(22) Filed: May 22, 2014

(65) Prior Publication Data

US 2014/0268640 A1 Sep. 18, 2014

Related U.S. Application Data

(63) Continuation of application No. 13/287,631, filed on Nov. 2, 2011, now Pat. No. 8,757,841.

(30) Foreign Application Priority Data

Nov. 8, 2010 (KR) ..... 10-2010-0110464
Nov. 15, 2010 (KR) ..... 10-2010-0113542
Dec. 3, 2010 (KR) ..... 10-2010-0122745

(51) Int. Cl.
*F21V 21/00* (2006.01)
*F21S 9/00* (2006.01)
(Continued)

(52) U.S. Cl.
CPC ..... *F21V 29/2268* (2013.01); *F21K 9/135* (2013.01); *F21K 9/1355* (2013.01);
(Continued)

(58) Field of Classification Search
USPC ..... 362/249.02, 249.01, 373, 294
See application file for complete search history.

(56) References Cited

U.S. PATENT DOCUMENTS

2006/0227558 A1 10/2006 Osawa et al.
2009/0103296 A1 4/2009 Harbers et al.
(Continued)

FOREIGN PATENT DOCUMENTS

CN 201318564 Y 9/2009
CN 101660741 A 3/2010
(Continued)

OTHER PUBLICATIONS

European Search Report dated Oct. 29, 2012 for EP11186424.5.
(Continued)

*Primary Examiner* — Mariceli Santiago
(74) *Attorney, Agent, or Firm* — Lowe Hauptman & Ham, LLP

(57) ABSTRACT

A lighting device comprises: a heat sink which comprises one surface and a receiving recess; a light emitting module which is disposed on the one surface of the heat sink and comprises a substrate and a plurality of light sources disposed on the substrate, wherein the substrate has a first hole disposed at the center thereof and a second hole; a power controller which is electrically connected to the light emitting module through the second hole of the substrate and is disposed in the receiving recess of the heat sink, wherein the light emitting module comprises a first light emitting module comprising a first substrate and a first light source, and a second light emitting module comprising a second substrate and a second light source, wherein the first substrate and the second substrate are disposed adjacent to each other.

20 Claims, 18 Drawing Sheets

(51) Int. Cl.

| | |
|---|---|
| ***F21V 29/00*** | (2006.01) |
| ***F21K 99/00*** | (2010.01) |
| ***F21V 3/00*** | (2006.01) |
| ***F21V 19/00*** | (2006.01) |
| ***F21V 23/00*** | (2006.01) |
| *F21Y 101/02* | (2006.01) |
| *F21Y 105/00* | (2006.01) |
| *F21Y 113/00* | (2006.01) |

(52) U.S. Cl.

CPC ..... *F21V 3/00* (2013.01); *F21V 19/0055* (2013.01); *F21V 29/2231* (2013.01); *F21Y 2101/02* (2013.01); *F21Y 2105/003* (2013.01); *F21V 23/005* (2013.01); *F21V 29/246* (2013.01); *F21V 23/006* (2013.01); *F21Y 2113/00* (2013.01); *F21Y 2113/005* (2013.01)

(56) References Cited

U.S. PATENT DOCUMENTS

| | | | |
|---|---|---|---|
| 2010/0165624 | A1 | 7/2010 | Ogawa et al. |
| 2011/0068687 | A1 | 3/2011 | Takahasi et al. |
| 2012/0002421 | A1 | 1/2012 | Takahasi et al. |

FOREIGN PATENT DOCUMENTS

| | | | |
|---|---|---|---|
| CN | 101680613 | A | 3/2010 |
| EP | 1600691 | | 11/2005 |
| EP | 2202446 | A2 | 6/2010 |
| JP | 2006-261039 | | 9/2006 |
| JP | 2009-004130 | | 1/2009 |
| JP | 2009-093926 | | 4/2009 |
| JP | 2009-163954 | | 7/2009 |
| JP | 2009-206104 | | 9/2009 |
| JP | 2009-301810 | | 12/2009 |
| JP | 3159084 | | 5/2010 |
| JP | 2010090012 | A1 | 8/2010 |
| JP | 2010119580 | A1 | 10/2010 |
| KR | 0322848 | | 7/2003 |
| KR | 1020070081490 | | 8/2007 |
| KR | 1020090004283 | | 1/2009 |
| KR | 1020090093963 | | 9/2009 |
| KR | 0446413 | | 10/2009 |
| KR | 1020100010321 | | 2/2010 |
| KR | 100946548 | | 3/2010 |
| KR | 1020100064800 | | 6/2010 |
| KR | 1020100066033 | | 6/2010 |
| KR | 1020100076153 | | 7/2010 |
| KR | 2010-0009895 | | 10/2010 |
| KR | 1020100117797 | | 11/2010 |
| KR | 1020100120852 | | 11/2010 |

OTHER PUBLICATIONS

The Office Action of SIPO (State Intellectual Property Office of the People's Republic of China) for application No. 201110347904.8 dated Oct. 8, 2014.

European Search Report for application no. 14195568.May 1757 dated Mar. 11, 2015, citing the above reference(s).

LIGHTING DEVICE

CROSS-REFERENCE TO RELATED APPLICATION

The present application is a Continuation Application of U.S. Ser. No. 13/287,631, filed on Nov. 2, 2011. It claims the priority of Korean Patent Application Nos. 10-2010-0110464, filed on Nov. 8, 2010; 10-2010-0113542, filed on Nov. 15, 2010; and 10-2010-0122745, filed on Dec. 3, 2010 in the KIPO (Korean Intellectual Property Office), which is incorporated herein by reference in its entirety.

BACKGROUND

1. Field

Embodiments may relate to a lighting device.

2. Background

A light emitting diode (LED) is an energy device for converting electric energy into light energy. Compared with an electric bulb, the LED has higher conversion efficiency, lower power consumption and a longer life span. As there advantages are widely known, more and more attentions are now paid to a lighting apparatus using the LED.

The lighting apparatus using the LED are generally classified into a direct lighting apparatus and an indirect lighting apparatus. The direct lighting apparatus emits light emitted from the LED without changing the path of the light. The indirect lighting apparatus emits light emitted from the LED by changing the path of the light through reflecting means and so on. Compared with the direct lighting apparatus, the indirect lighting apparatus mitigates to some degree the intensified light emitted from the LED and protects the eyes of users.

SUMMARY

One embodiment is a lighting device. The lighting device comprises: a heat sink which comprises one surface and a receiving recess; a light emitting module which is disposed on the one surface of the heat sink and comprises a substrate and a plurality of light sources disposed on the substrate, wherein the substrate has a first hole disposed at the center thereof and a second hole; a power controller which is electrically connected to the light emitting module through the second hole of the substrate and is disposed in the receiving recess of the heat sink, wherein the light emitting module comprises a first light emitting module comprising a first substrate and a first light source, and a second light emitting module comprising a second substrate and a second light source, wherein the first substrate and the second substrate are disposed adjacent to each other, and the first light source and the second light source are disposed adjacent to each other, and wherein a distance from the center of the first light source to the center of the first hole of the first substrate is substantially the same as a distance from the center of the first light source to the center of the second light source.

Another embodiment is a lighting device. The lighting device comprises: a heat sink which comprises one surface and a receiving recess; a light emitting module which is disposed on the one surface of the heat sink; and a power controller which electrically connected to the light emitting module and is disposed in the receiving recess of the heat sink, wherein the light emitting module comprises a first light emitting module and a second light emitting module, wherein the first and the second light emitting modules emit white light, wherein the white light of the first light emitting module has a color temperature different from that of the white light of the second light emitting module, wherein the one surface of the heat sink comprises a first seating recess in which the first light emitting module is disposed and a second seating recess in which the second light emitting module is disposed, and wherein the first seating recess and the second seating recess are partially connected with each other.

Another embodiment is a lighting device. The lighting device comprises: a heat sink which comprises one surface and a receiving recess; a light emitting module which is disposed on the one surface of the heat sink; and a power controller which electrically connected to the light emitting module and is disposed in the receiving recess of the heat sink, wherein at least three light emitting modules are provided, wherein the at least three light emitting modules are disposed on the one surface of the heat sink in the shape of "T", and wherein the white light of the first light emitting module has a color temperature different from that of the white light of at least one of the second and the third light emitting modules.

BRIEF DESCRIPTION OF THE DRAWINGS

Arrangements and embodiments may be described in detail with reference to the following drawings in which like reference numerals refer to like elements and wherein.

DETAILED DESCRIPTION

A thickness or a size of each layer may be magnified, omitted or schematically shown for the purpose of convenience and clearness of description. The size of each component may not necessarily mean its actual size.

It should be understood that when an element is referred to as being 'on' or "under" another element, it may be directly on/under the element, and/or one or more intervening elements may also be present. When an element is referred to as being 'on' or 'under', 'under the element' as well as 'on the element' may be included based on the element.

An embodiment may be described in detail with reference to the accompanying drawings.

Figure 1:
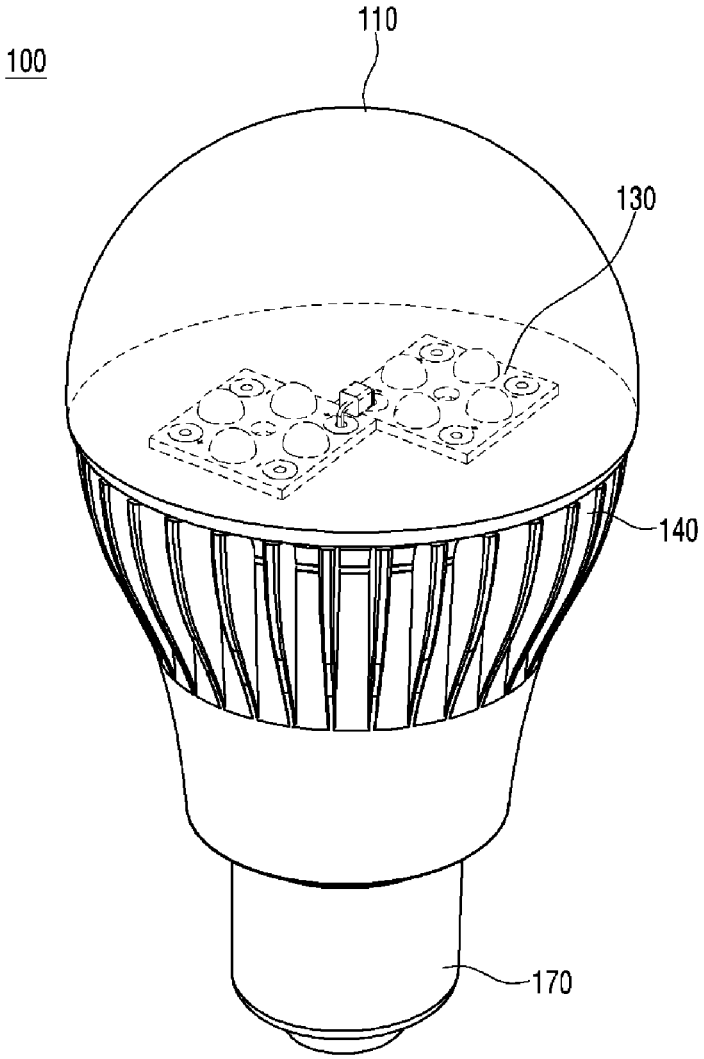
FIG. 1 is a perspective view showing an embodiment of a lighting device.
Figure 2:
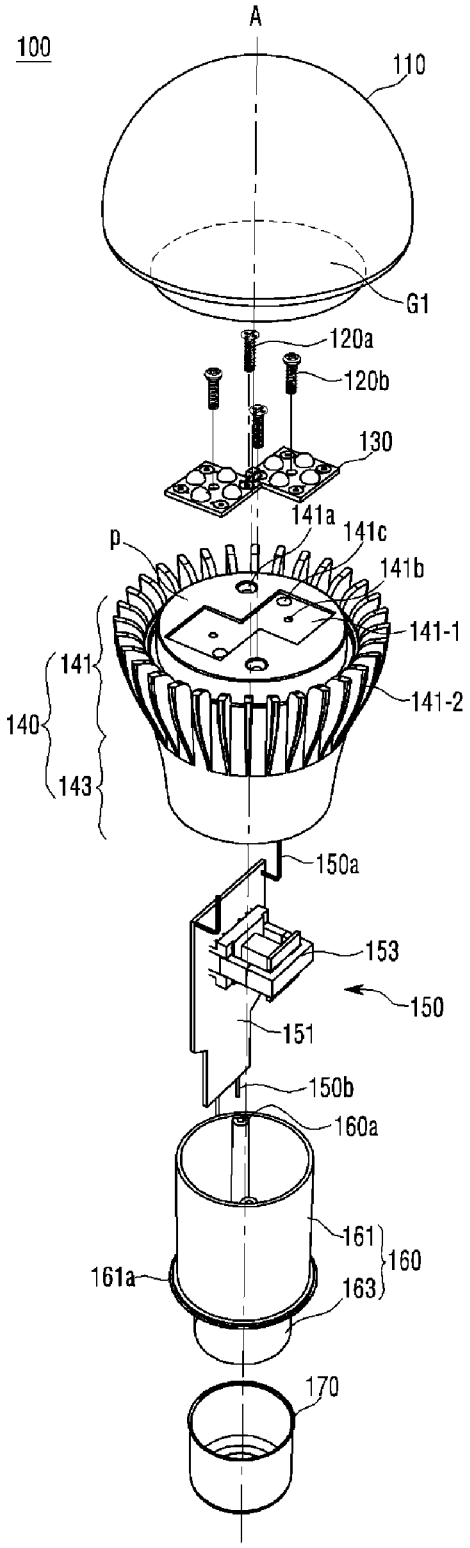
FIG. 2 is an exploded perspective view of the lighting device shown in FIG. 1.
Figure 3:
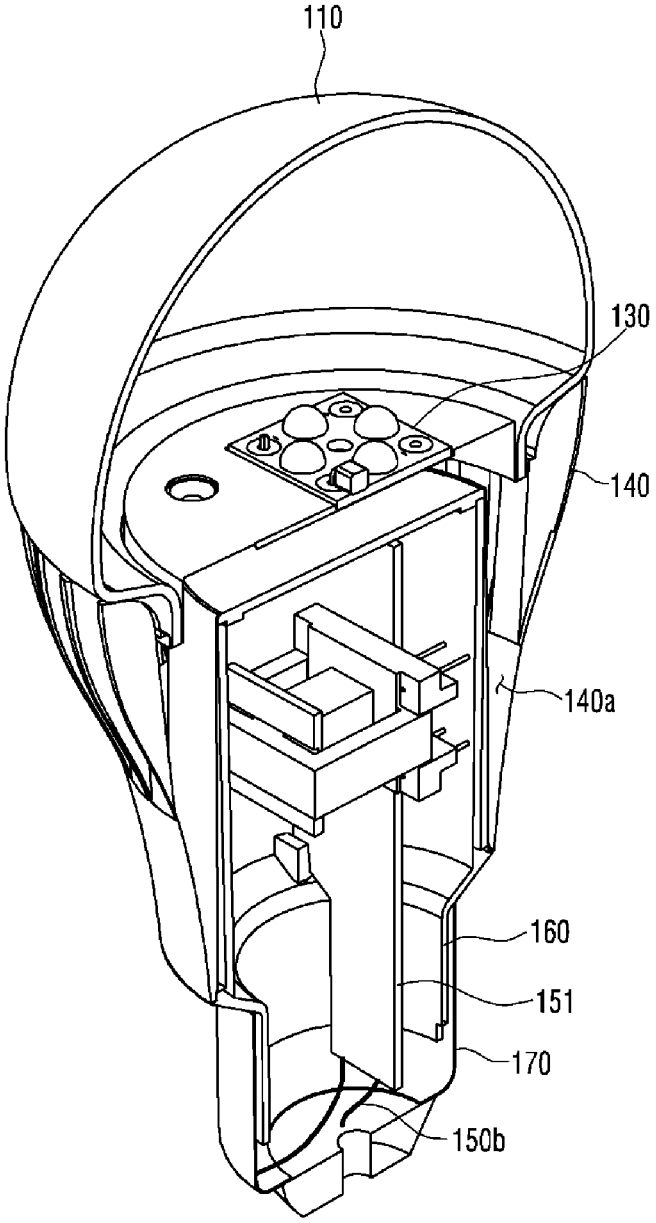
FIG. 3 is a cross sectional view of the lighting device shown in FIG. 1.
Figure 4:
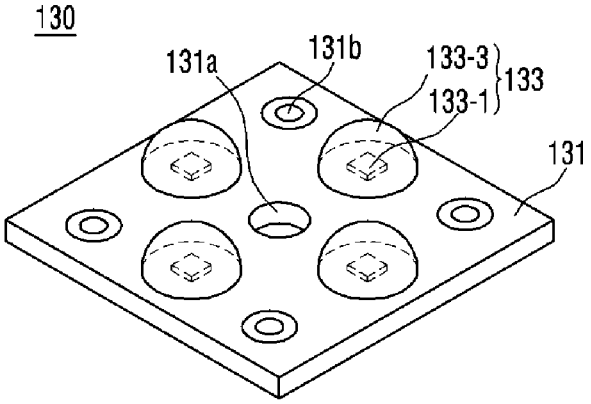
FIG. 4 is a perspective view of a light emitting module shown in FIG. 1.

FIG. 1 is a perspective view showing an embodiment of a lighting device. FIG. 2 is an exploded perspective view of the lighting device shown in FIG. 1, FIG. 3 is a cross sectional view of the lighting device shown in FIG. 1. FIG. 4 is a perspective view of a light emitting module shown in FIG. 1.

Referring to FIGS. 1 to 4, a lighting device 100 may include a cover 110, a light emitting module 130, a heat sink 140, a power controller 150 and an inner case 160.

The cover 110 surrounds and protects the light emitting module 130 from external impacts. The cover 110 also distributes light generated by the light emitting module 130 to the front or rear (top or bottom) of the lighting device 100.

The heat sink 140 radiates heat to the outside generated from the light emitting module 130 due to the drive of the lighting device 100. The heat sink 140 improves heat radiation efficiency through as much surface contact with the light emitting module 130 as possible. Here, the heat sink 140 may be coupled to the light emitting module 130 by using an adhesive. Additionally, it is recommended that they should be coupled to each other by using a fastening means 120*b*, for example, a screw.

The inner case 160 receives the power controller 150 therein, and then is received by the heat sink 140.

Hereafter, the lighting device 100 according to the embodiment will be described in detailed focusing on its constituents.

<Cover>

The cover 110 has a bulb shape having an opening 'G1'. The inner surface of the cover 110 may be coated with an opalesque pigment. The pigment may include a diffusing material such that light passing through the cover 110 can be diffused throughout the inner surface of the cover 110.

The cover 110 may be formed of glass. However, the glass is vulnerable to weight or external impact. Therefore, plastic, polypropylene (PP) and polyethylene (PE) and the like can be used as the material of the cover 110. Here, polycarbonate (PC), etc., having excellent light resistance, excellent thermal resistance and excellent impact strength property can be also used as the material of the cover 110.

<Light Emitting Module>

The light emitting module 130 may include a substrate 131 and a light source unit 133 disposed on the substrate 130.

The substrate 131 has a quadrangular shape and there is no limit to the shape of the substrate 130. However, as shown in the embodiment, when the substrate 131 has a quadrangular shape, the substrate 130 has a hole 131*a* in its central portion and a via-hole 131*b* in its corner portion. When a plurality of the substrates 131 are disposed on a specific surface like one surface of the heat sink 140, the via hole 131*b* can function as a path for wiring or a connector for electrically connecting the adjacent substrates.

The substrate 131 may be formed by printing a circuit pattern on an insulator and may include, for example, a common printed circuit board (PCB), a metal core PCB, a flexible PCB and a ceramic PCB and the like. Here, the substrate 131 may be a chips on board (COB) allowing an unpackaged LED chip to be directly bonded thereon. The COB type substrate includes a ceramic material to obtain insulation and thermal resistance against heat generated by driving the lighting device 100.

The substrate 131 may be also formed of a material capable of efficiently reflecting light, or the surface of the substrate 131 may have color capable of efficiently reflecting light, for example, white and silver and the like.

A plurality of the light source unit 133 may be disposed on the substrate 131. The light source unit 133 may include a light emitting device 133-1 and a lens 133-3.

A plurality of the light emitting device 133-1 may be disposed on one side of the substrate 131. The light emitting device 133-1 may be a light emitting diode chip emitting blue, red or green light or may be a light emitting diode chip emitting UV.

Also, the light emitting diode of the light emitting device 133-1 may have a lateral type or a vertical type. The light emitting diode may emit blue, red or green light.

The lens 133-3 is disposed on the substrate 131 in such a manner as to cover the light emitting device 133-1. The lens 133-3 is able to adjust the orientation angle or direction of light emitted from the light emitting device 133-1.

The lens 133-3 has a hemispherical shape. The inside of the lens 133-3 may be entirely filled with a light transmitting resin like a silicon resin or epoxy resin without an empty space. The light transmitting resin may entirely or partially include distributed fluorescent material.

Here, when the light emitting device 133-1 is a blue light emitting diode, the fluorescent material included in the light transmitting resin of the lens 133-3 may include at least any one selected from a group consisting of a garnet based material (YAG, TAG), a silicate based material, a nitride based material and an oxynitride based material.

Though natural light (white light) can be created by allowing the light transmitting resin to include only yellow fluorescent material, the light transmitting resin may further include a green fluorescent material or a red fluorescent material in order to improve a color rendering index and to reduce a color temperature.

When the light transmitting resin of the lens 133-3 is mixed with many kinds of fluorescent materials, an addition ratio of the color of the fluorescent material may be formed such that the green fluorescent material is more used than the red fluorescent material, and the yellow fluorescent material is more used than the green fluorescent material.

The garnet based material, the silicate based material and the oxynitride based material may be used as the yellow fluorescent material. The silicate based material and the oxynitride based material may be used as the green fluorescent material. The nitride based material may be used as the red fluorescent material.

The lens 133-3 may be formed not only by mixing the fluorescent material with the light transmitting resin, but also by stacking layers including the red, green and yellow fluorescent materials.

Figure 5:
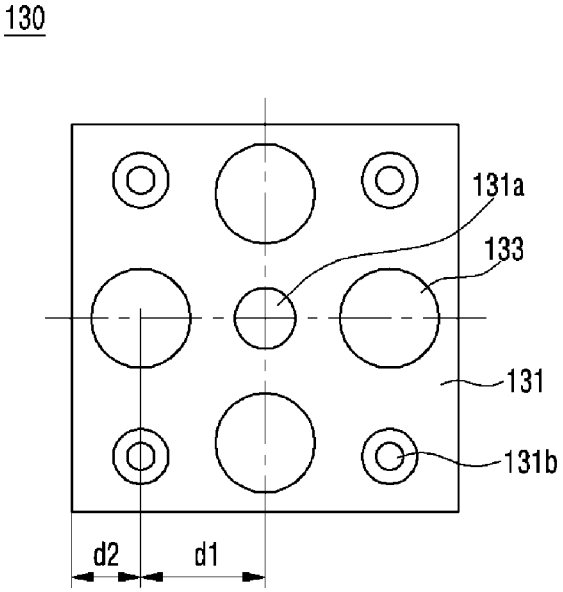
FIG. 5 is a view for describing the light emitting module shown in FIG. 1.

FIG. 5 is a view for describing the light emitting module 130 shown in FIG. 1; Referring to FIGS. 1 and 5, the substrate 131 may include the hole 131*a* and the via-hole 131*b*. The hole 131*a* may be placed at the center of the substrate 131 and the via-hole 131*b* may be placed in each corner of the substrate 131. The hole 131*a* may function as either a standard for the arrangement of the light source units 133 or a hole through which the fastening means 120*b*, for example, a screw, is passed when the substrate 131 is coupled to the heat sink 140. When a plurality of the substrates are disposed on the heat sink 140, the via-hole 131*b* the via hole 131*b* can function as a path for wiring or a connector for electrically connecting the adjacent substrates.

A plurality of the light source units 133 may be disposed up, down, right and left with respect to the hole 131*a* formed at the center of the substrate 131. The plurality of the light source units 133 may be disposed symmetrically with each other with respect to the hole 131*a*. Here, though the light source units 133 may be disposed on the substrate 131 in various forms, it is recommended that the light source units 133 should be disposed symmetrically with respect to the hole 131*a* for the purpose of improvement of the uniformity characteristics of light emitted from the light source units 133.

A distance "d1" from the center of the light source unit 133 to the center of the hole 131*a* formed at the center of the substrate 131 is greater than a distance "d2" from the center of the light source unit 133 to the edge of the substrate 131. This intends to improve the uniformity characteristics of the light emitted from the light emitting module 130. If "d1" is less than "d2", the uniformity characteristics of the light is substantially deteriorated because the light emitted from the light emitting module 130 is focused entirely on the central portion of the light emitting module 130.

Figure 6:
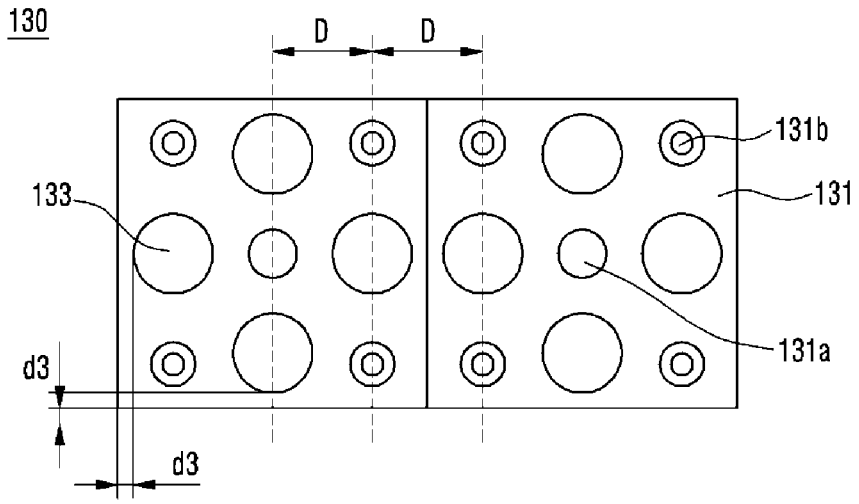
FIGS. 6 and 7 are views for describing an arrangement of a plurality of the light emitting modules shown in FIG. 1.
Figure 7:
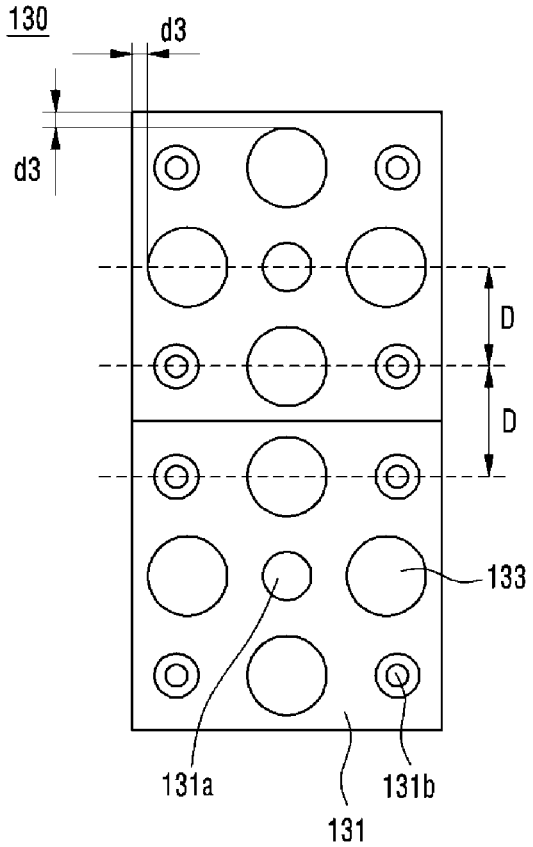

FIGS. 6 and 7 are views for describing an arrangement of a plurality of the light emitting modules shown in FIG. 1.

Referring to FIGS. 6 and 7, substrates of two light emitting modules are disposed adjacent to each other. A distance "D" from the center of the light source unit of a first light emitting module to the center of a hole of a first light emitting module (that is, a light emitting module placed to the left of FIG. 6 and a light emitting module placed on the upper side of FIG. 7) out of the two light emitting modules is the same as a distance "D" from the center of the light source unit of the first light emitting module to the center of the light source unit of a second light emitting module (that is, a light emitting module placed to the right of FIG. 6 and a light emitting module placed on the lower side of FIG. 7). Accordingly, light generated from two adjacent light emitting modules 130 is able to maintain the uniformity characteristics as it is of light generated from one light emitting module 130.

Regarding the plurality of the light source units 133, distances "d3" from the end of the substrate 131 to the ends of the plurality of the light source units 133 may be the same as each other.

Figure 8:
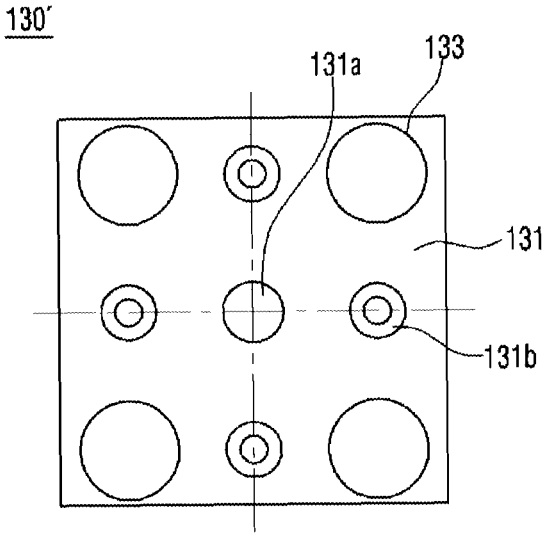
FIG. 8 is a view for describing another embodiment of the light emitting module shown in FIG. 4.

FIG. 8 is a view for describing another embodiment of the light emitting module shown in FIG. 4.

Referring to FIG. 8, like the light emitting module 130 shown in FIG. 5, a light emitting module 130' includes the substrate 131 and the light source unit 133. The descriptions of the substrate 131 and the light source unit 133 which are shown in FIG. 8 can be replaced with the foregoing descriptions.

The light source unit 133 and the via-hole 131*b* of the light emitting module 130' shown in FIG. 8 are disposed differently from the light source unit 133 and the via-hole 131*b* of the light emitting module 130 shown in FIG. 5.

The via-holes 131*b* of the light emitting module 130' shown in FIG. 8 are disposed up, down, right and left with respect to the hole 131*a* formed at the center of the substrate 131. The light source unit 133 is disposed in each corner of the substrate 131.

<Heat Sink>

The heat sink 140 includes a receiving recess 140*a* into which the power controller 150 and the inner case 160 are inserted.

The heat sink 140 may include one surface "p" on which the light emitting module 130 is disposed. The one surface "p" may be, as shown in the drawings, flat or may be curved to have a predetermined curvature. The one surface "p" may be also, as shown in the drawings, circular or may be polygonal or elliptical.

The one surface "p" may include a seating recess 141-1 in which at least one light emitting module 130 is seated. The one surface "p" may also include a first recess 141*a*, a second recess 141*b* and a third recess 141*c*.

A first fastening means 120*a* like a first screw 120*a* is inserted into the first hole 141*a*, and then the first screw 120*a* is inserted into a fastening hole 160*a* formed in the inner surface of the inner case 160, so that the heat sink 140 is coupled to the inner case 160.

A second fastening means 120*b* like a second screw 120*b* which has passed through the hole 131*a* formed at the center of the light emitting module 130 is inserted into the second hole 141*b*, so that the heat sink 140 is coupled to the light emitting module 130. Accordingly, heat generated from the light emitting module 130 is effectively transferred to the heat sink 140. As a result, heat radiating characteristic can be improved.

An electrode pin 150*a* of the power controller 150 passes through the third hole 141*c*. The electrode pin 150*a* which has passed through the third hole 141*c* may be inserted into toe via-hole 131*b* of the light emitting module 130.

The heat sink 140 may include an upper portion 141 and a lower portion 143. The upper portion 141 may have a cylindrical shape. The cylindrical upper portion 141 may have the one surface "p" on which the light emitting module 130 is disposed. The lower portion 143 may have a cylindrical shape. The cylindrical lower portion 143 extends from the cylindrical upper portion 141. The diameter of the cylindrical lower portion 143 decreases downward along a central axis "A" which penetrates the center of the one surface "p".

Either the area or the height of the one surface "p" of the cylindrical upper portion 141 may be changed according to the total volume of the light emitting module 130 or the entire length of the power controller 150.

Fins 141-2 may be disposed on the lateral surface of the heat sink 140. Specifically, a plurality of the fins 141-2 may be disposed on the lateral surface of the cylindrical upper portion 141 in the longitudinal direction of the cylindrical upper portion 141. The plurality of the fins 141-2 may be radially disposed along the surface of the cylindrical upper portion 141. The plurality of the fins 141-2 increase the surface area of the cylindrical upper portion 141 to improve the heat radiation efficiency. Here, although the plurality of the fins 141-2 are formed only on the cylindrical upper portion 141 in the drawings, the plurality of the fins 141-2 may be also formed on the surface of the cylindrical lower portion 143. For example, the plurality of the fins 141-2 may be formed extending from the surface of the cylindrical upper portion 141 to the surface of the cylindrical lower portion 143.

The heat sink 140 is formed of a metallic material or a resin material which has excellent heat radiation efficiency. There is no limit to the material of the heat sink 140. For example, the material of the heat sink 140 can include at least one of Al, Ni, Cu, Ag and Sn.

Though not shown in the drawings, a heat radiating plate (not shown) may be disposed between the light emitting module 130 and the heat sink 140. The heat radiating plate (not shown) may be formed of a material having a high thermal conductivity such as a thermal conduction silicon pad or a thermal conduction tape and the like, and is able to effectively transfer heat generated by the light emitting module 130 to the heat sink 140.

<Power Controller>

The power controller 150 includes a support plate 151 and a plurality of parts 153 mounted on the support plate 151. The plurality of the parts 153 includes, for example, a DC converter converting. AC power supplied by an external power supply into DC power, a driving chip controlling the driving of the light emitting module 130, and an electrostatic discharge (ESD) protective device for protecting the light emitting module 130, and the like. However, there is no limit to the parts.

The power controller 150 may include the electrode pin 150*a* which projects outwardly from the support plate 151 or is connected to the support plate 151.

The electrode pin 150*a* may pass through the third hole 141*c* formed in the cylindrical upper portion 141 of the heat sink 140, and may be inserted into the via-hole 131*b* of the light emitting module 130. The electrode pin 150*a* supplies electric power to the light emitting module 130 from the power controller 150.

<Inner Case>

The inner case 160 may include an insertion portion 161 which is inserted into the receiving recess 140*a* of the heat sink 140, and a connector 163 which is electrically connected to an external power supply.

The inner case 160 may be formed of a material having excellent insulation and durability, for example, a resin material.

The insertion portion 161 has a cylindrical shape with an empty interior. The insertion portion 161 is inserted into the receiving recess 140*a* of the heat sink 140 and prevents an electrical short-circuit between the power controller 150 and the heat sink 140. Therefore, a withstand voltage of the lighting device 100 can be improved.

The insertion portion 161 may include the fastening hole 160*a*. The fastening hole 160*a* may be formed in the inner surface of the insertion portion 161. The first screw 120*a* which has passed through the first recess 141*a* of the heat sink 140 is inserted and fixed to the fastening hole 160*a*.

The insertion portion 161 may include a guide 161*a*. The guide 161*a* may be formed to project from the outer circumferential surface of the insertion portion 161. When the insertion portion 161 is inserted into the receiving recess 140*a* of the heat sink 140, the guide 161*a* supports the side ends of the receiving recess 140*a* of the heat sink 140.

The connector 163 may be formed extending from the insertion portion 161. The connector 163 may be coupled to a socket 170.

<Socket>

The socket 170 is coupled to the connector 163 of the inner case 160 and is electrically connected to an external power supply.

<Mechanical and Electrical Connection Structure Between the Power Controller and the Inner Case>

The power controller 150 may be disposed in the receiving recess 140*a* of the heat sink 140.

The support plate 151 of the power controller 150 may be disposed perpendicularly with respect to one side of the substrate 131 such that air flows smoothly in the inner case 160. Accordingly, as compared with a case where the support plate 151 is disposed horizontally with respect to one side of the substrate 131, air flows up and down in the inner case 160 due to convection current, thereby improving the heat radiation efficiency of the lighting device 100.

Meanwhile, the support plate 151 may be disposed in the inner case 160 perpendicularly to the longitudinal direction of the inner case 160. There is no limit to how the support plate 151 is disposed.

The power controller 150 may be electrically connected to the socket 170 through a first wiring 150*b* and may be electrically connected to the light emitting module 130 through the electrode pin 150*a*. Specifically, the first wiring 150*b* is connected to the socket 170, and then can be supplied an electric power from an external power supply. Also, the electrode pin 150*a* passes through the third recess 141*c* of the heat sink 140 and is able to electrically connect the power controller 150 with the light emitting module 130.

Figure 9:
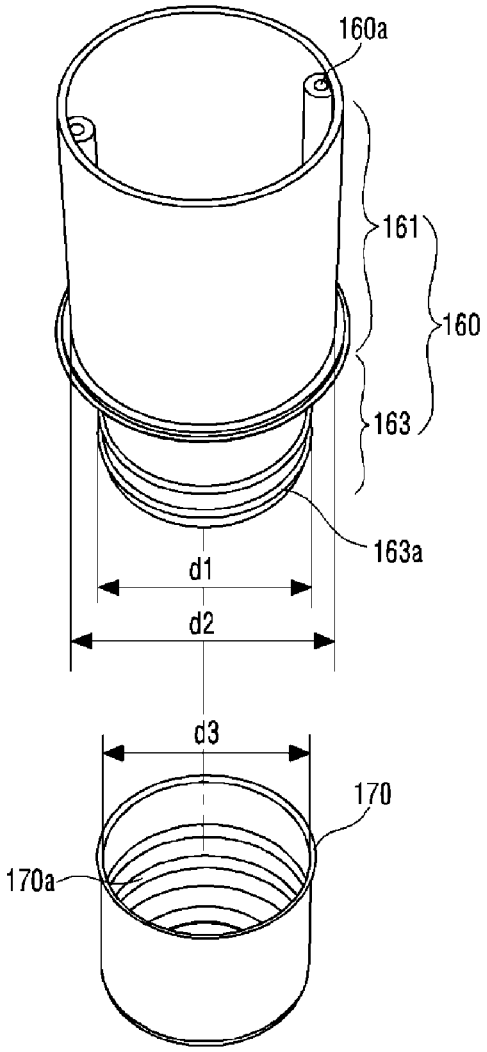
FIG. 9 is a view for describing the coupling of an inner case and a socket which are shown in FIG. 2.

FIG. 9 is a view for describing the coupling of an inner case and the socket which are shown in FIG. 2.

Referring to FIG. 9, the inner case 160 can be coupled to the socket 170 by the rotation of the socket 170. For example, when the outer surface of the connector 163 of the inner case 160 includes a screw thread 163*a* and the inner surface of the socket 170 includes a screw groove 170*a* corresponding to the screw thread 163*a*, the inner case 160 can be coupled to the socket 170 by the coupling of the screw thread and the screw groove. Here, the outer surface of the connector 163 of the inner case 160 may include the screw groove and the inner surface of the socket 170 may include the screw thread corresponding to the screw groove.

The diameter "d1" of the connector 163 of the inner case 160 is less than the diameter "d2" of the insertion portion 161 of the inner case 160. Also, the diameter "d3" of the socket 170 is less than the diameter "d2" of the insertion portion 161 of the inner case 160. This intends to allow the lighting device 100 to have a shape capable of substituting for a conventional lighting device.

While the inner case 160 includes the insertion portion 161 and the connector 163 having a diameter less than that of the insertion portion 161, the insertion portion 161 and the connector 163 are allowed to have the same diameter as one body. In this case, a screw thread or a screw groove is formed on the outer surface of the connector 163, and then the connector 163 is coupled to the socket 170. Such a structure improves assemblability of the lighting device and makes it easier to repair structures like the power controller 150 disposed in the inner case 160.

FIGS. 10*a* to 10*h* are views for describing an assembly process of the lighting device shown in FIG. 2.

Figure 10A:
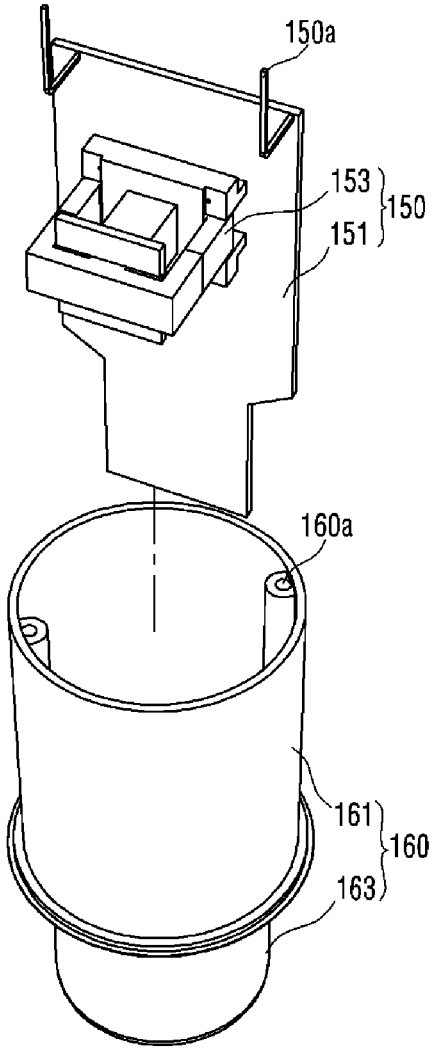
FIGS. 10*a* to 10*h* are views for describing an assembly process of the lighting device shown in FIG. 2.

Referring to FIG. 10*a*, the power controller 150 is inserted into the insertion portion 161 of the inner case 160. Here, though not shown, a guider groove (not shown) may be formed in the inner surface of the inner surface 160 such that the support plate 151 of the power controller 150 is coupled to the inner surface of the inner case 160 in a sliding manner. The guider groove (not shown) may be formed in the longitudinal direction of the inner case 160.

Figure 10B:
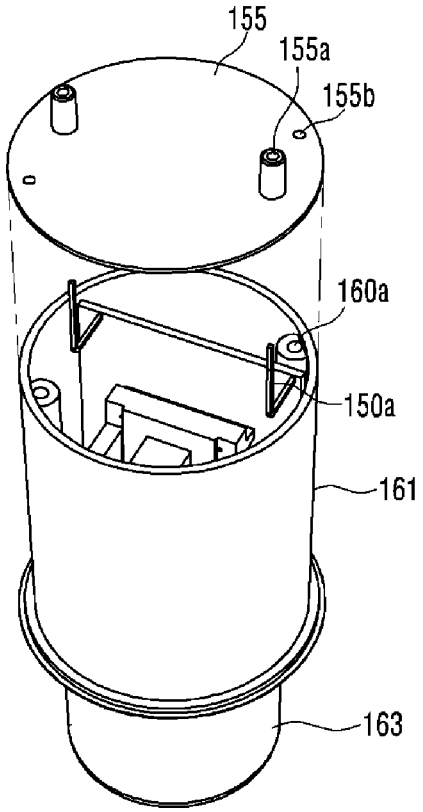
Figure 10C:
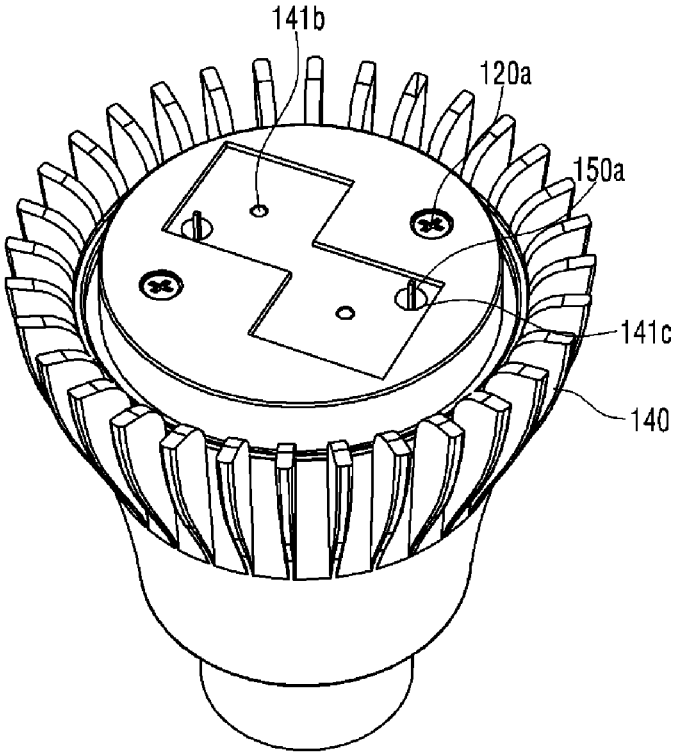

Next, referring to FIG. 10*b*, a holder 155 is located at the end of the insertion portion 161 of the inner case 160 and seals the inner case 160 such that the electrode pin 150*a* of the power controller 150 disposed in the insertion portion 161 of the inner case 160 is securely fixed and electrically coupled to the light emitting module 130. Here, the holder 155 includes a protrusion portion 155*a* having a through-hole allowing the electrode pin 150*a* to pass through the through-hole. The holder 155 also includes an auxiliary hole 155*b* allowing the first screw 120*a* fastening the heat sink 140 to the inner case 160 to pass through the auxiliary hole 155*b*. Since the holder 155 functions as a means for securely fixing and supporting the electrode pin 150*a*, the holder 155 may not be used in some cases.

Next, referring to FIG. 10*b*, an assembly of the inner case 160 and the power controller 150 is coupled to the heat sink 140. In this case, the insertion portion 161 of the inner case 160 is inserted into the receiving recess 140*a* of the heat sink 140 shown in FIG. 3. The inner case 160 and the heat sink 140 are fixed by the first screw 120*a*. Here, the electrode pin 150*a* of the power controller 150 passes through the third hole 141*c* of the heat sink 140 and projects.

Figure 10D:
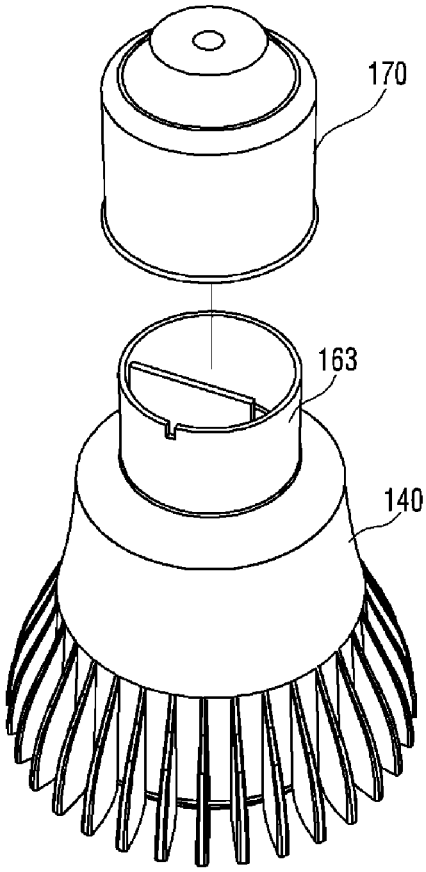

Referring to FIG. 10*d*, the socket 170 is coupled to the connector 163 of the inner case 160. Through a wiring connection, the socket 170 is electrically connected to the power controller 150 disposed in the inner case 160.

Figure 10E:
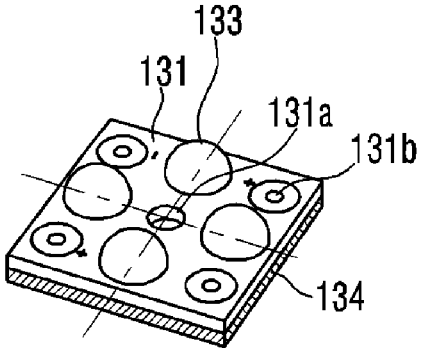

Referring to FIG. 10*e*, a thermal grease 134 is applied on the bottom surface of the substrate 131 of the provided light emitting module 130. The light emitting module 130 includes a plurality of the light source units 133. The light source units 133 are disposed symmetrically with each other with respect to the hole 131*a* formed at the center of the substrate 131. Specifically, the light source units 133 are disposed on the substrate 131 symmetrically up, down, right and left with respect to the hole 131*a* formed at the center of the substrate 131. Though the light source units 133 may be disposed on the substrate 131 in various forms, it is recommended that the light source units 133 should be disposed symmetrically with respect to the hole 131*a* for the purpose of improvement of the uniformity characteristics of light emitted from the light source units 133.

Figure 10F:
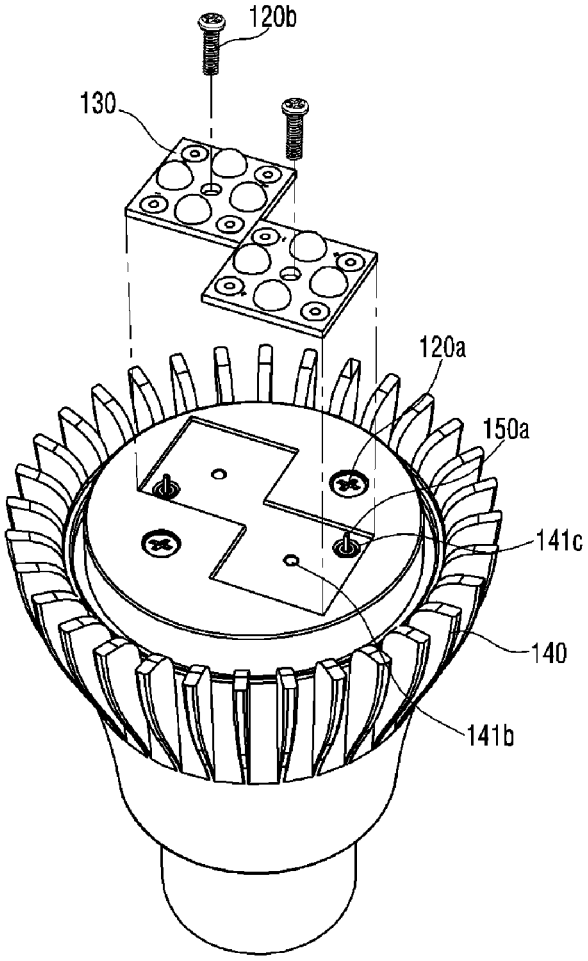

Referring to FIG. 10*f*, the light emitting module 130 and an assembly including the inner case 160, the power controller 150 and the heat sink 140 are coupled to each other by using the second screw 120*b*. Here, the second screw 120*b* fixes the light emitting module to the assembly by passing through the hole 131 formed at the central portion of the light emitting module 130 and the second hole 141*b* of the heat sink 140.

Figure 10G:
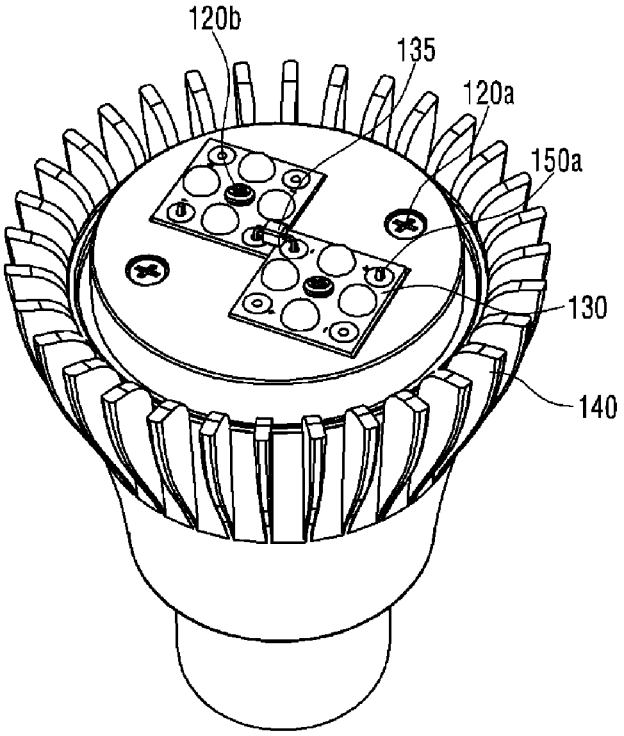

Referring to FIG. 10*g*, a connector 135 is connected to each via-hole 131*b* of two light emitting modules 130 such that the two light emitting modules 130 are electrically connected to each other. Here, the electrode pin 150*a* of the power controller 150 is soldered in such a manner as to be electrically connected to the substrate 131 of the light emitting module 130.

Figure 10H:
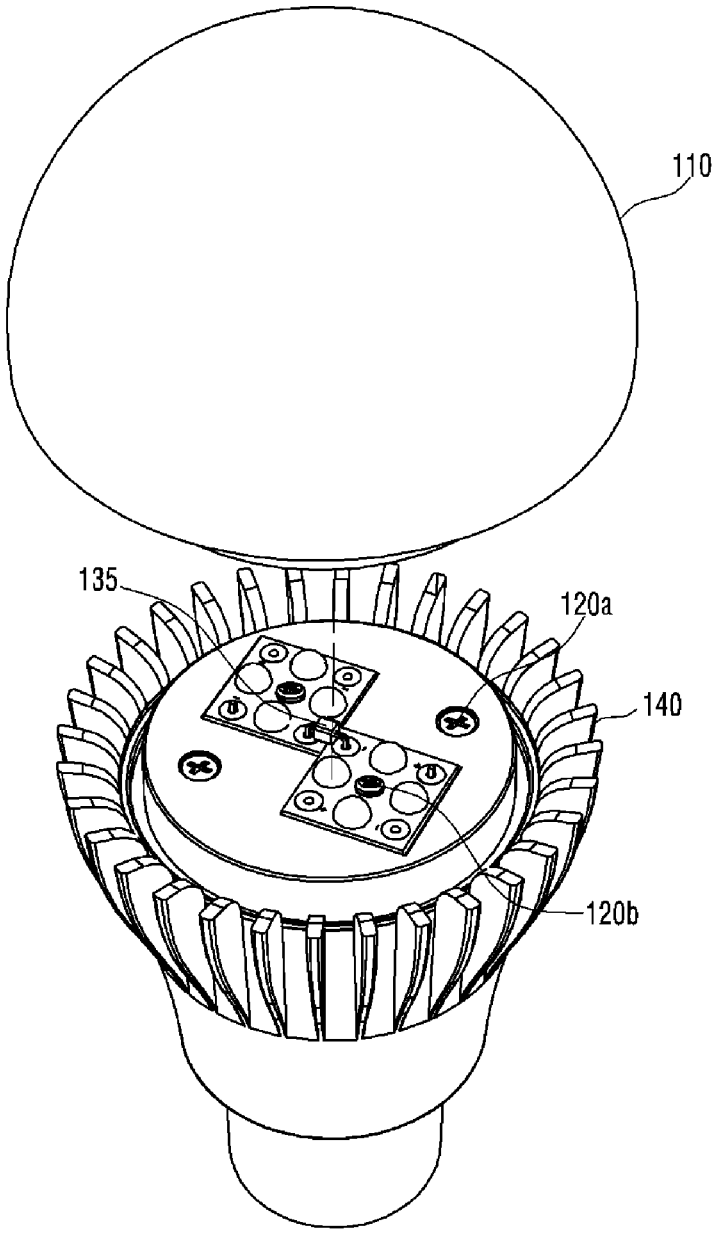

Referring to FIG. 10*h*, the cover 110 is silicon-bonded and coupled to the heat sink in such a manner as to cover the light emitting module 130.

Since the lighting device 100 has a structure capable of substituting for a conventional incandescent bulb, it is possible to use equipments for the conventional incandescent bulb without the use of a mechanical connection structure for a new lighting device or without the improvement of assembly.

Figure 11:
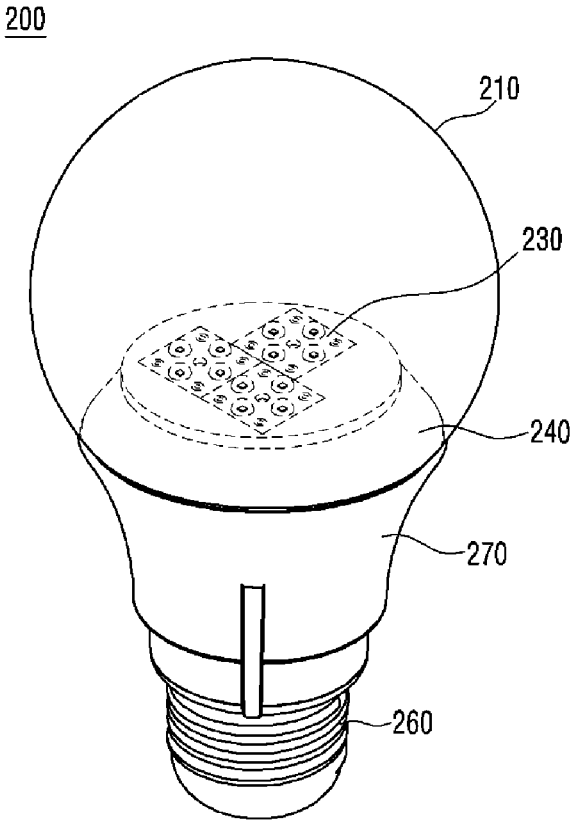
FIG. 11 is a perspective view of a lighting device according to further another embodiment.
Figure 12:
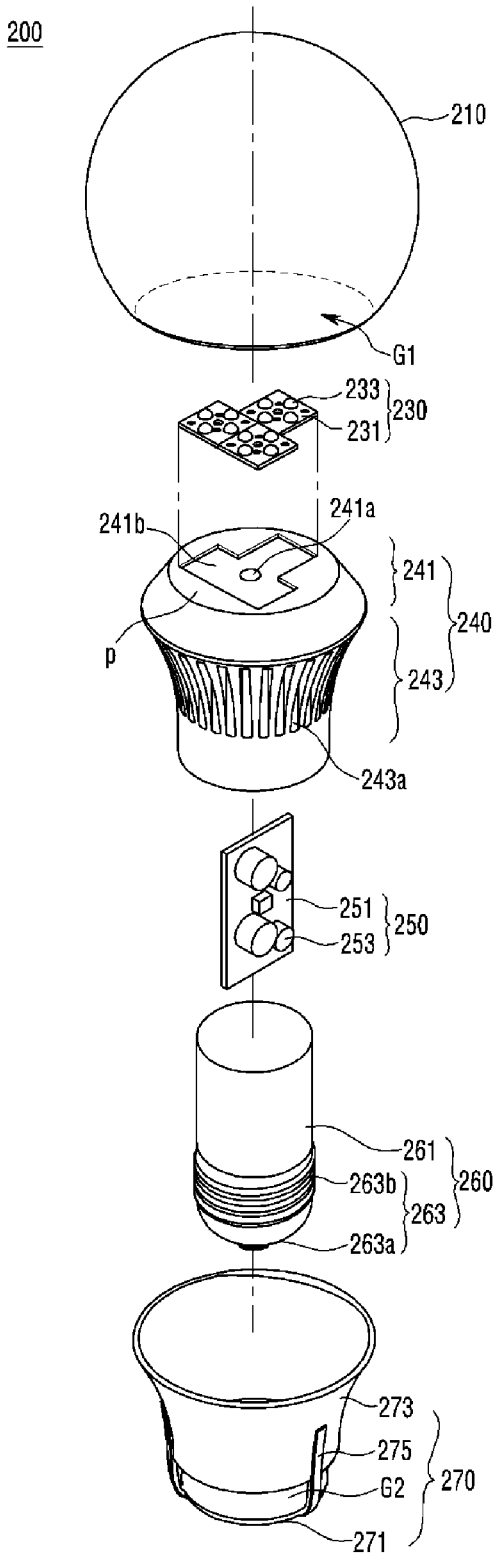
FIG. 12 is an exploded perspective view of the lighting device shown in FIG. 11.
Figure 13:
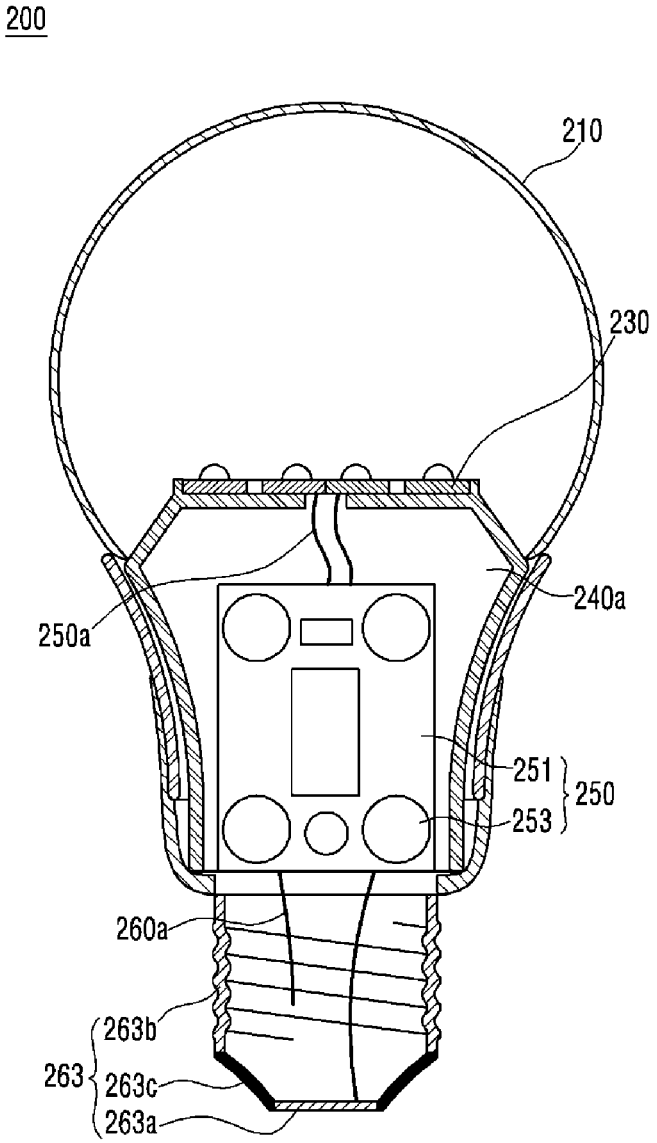
FIG. 13 is a cross sectional view of the lighting device shown in FIG. 11.

FIG. 11 is a perspective view of a lighting device according to further another embodiment. FIG. 12 is an exploded perspective view of the lighting device shown in FIG. 11. FIG. 13 is a cross sectional view of the lighting device shown in FIG. 11.

Referring to FIGS. 11 to 13, a lighting device 200 according to another embodiment may include a cover 210, a light emitting module 230, a heat sink 240, a power controller 250, an inner case 260 and an outer case 270.

The cover 210 surrounds and protects the light emitting module 230 from external impacts. The cover 210 also distributes light generated by the light emitting module 230 to the front or rear (top or bottom) of the lighting device 200.

The heat sink 240 radiates heat to the outside generated from the light emitting module 230 due to the drive of the lighting device 200. The heat sink 240 improves heat radiation efficiency through as much surface contact with the light emitting module 230 as possible. The outer case 270 receives the heat sink 240, the power controller 250 and the inner case 260 and the like. The outer case 270 and the cover 210 determine the external appearance of the lighting device 200. Here, the outer case 270 may not be used.

Hereafter, the lighting device 200 according to the embodiment will be described in detail focusing on its constituents.

<Cover>

The cover 210 has a bulb shape having an opening 'G1'. The inner surface of the cover 210 may be coated with an opalesque pigment. The pigment may include a diffusing material such that light which is passing through the cover 210 can be diffused throughout the inner surface of the cover 210.

The cover 210 may be formed of glass. However, the glass is vulnerable to weight or external impact. Therefore, plastic, polypropylene (PP) and polyethylene (PE) and the like can be used as the material of the cover 210. Here, polycarbonate (PC), etc., having excellent light resistance, excellent thermal resistance and excellent impact strength property can be also used as the material of the cover 210.

<Light Emitting Module>

The light emitting module 230 may include a substrate 231 and a plurality of light source units 233 mounted on the substrate 231.

The substrate 231 and the light source unit 233 may be the same as the substrate 131 and the light source unit 133 shown in FIG. 4. The detailed description thereof is replaced with the foregoing description.

A plurality of the light emitting modules 230 may be disposed on one flat surface of an upper portion 241 of the heat sink 240. Specifically, three light emitting modules 230 may be disposed in two rows. That is, two light emitting modules 230 may be disposed in a first row and one light emitting module 230 may be disposed in a second row. The three light emitting modules 230 may be disposed entirely in the form of a triangle.

The plurality of the light emitting modules 230 may be disposed apart from each other at an interval on one surface of the heat sink 240, and preferably may be disposed adjacent to each other. Although the light emitting modules 230 are disposed adjacent to each other, the light source units 233 of the light emitting modules 230 may be uniformly disposed apart from each other at a regular interval. Further, the light source units 233 disposed in two adjacent light emitting modules 230 may be uniformly disposed apart from each other at a regular interval. As a result, substantially, light emitted from the entire light emitting modules 230 is able to have uniformity characteristics as it is of light generated from one light emitting module 230.

Color temperatures of light emitted from the plurality of the light emitting modules 230 may be different from each other. This can be implemented by varying the kind of fluorescent material included in the light source unit 233 of the light emitting module 230. When the color temperatures of light emitted from the plurality of the light emitting modules 230 are different from each other, it is possible to create emotional lighting.

The number and the disposition of the light emitting module 230 are not limited to the example shown in the drawings and may be changed according to the size of the heat sink 240, the light amount of the light emitting module 230 and the number of the light source units 233 included in the light emitting module 230. For example, while the embodiment shows the plurality of the light emitting modules 230 are disposed in the heat sink 240 in two rows, the light emitting modules 230 may be disposed in the heat sink 240 in two or more rows as the size of the heat sink 240 increases. Besides, the number of the light emitting modules 230 may also increase.

The light emitting module 230 shown in FIGS. 11 to 13 can be used as the light emitting module 130 shown in FIGS. 1 to 3.

<Heat Sink>

The heat sink 240 includes a receiving recess 240*a* into which the power controller 250 and the inner case 260 are inserted.

The heat sink 240 may include one surface "p" on which the plurality of the light emitting modules 230 are disposed. The one surface "p" may be, as shown in the drawings, flat or may be curved to have a predetermined curvature. The one surface "p" may be also, as shown in the drawings, circular or may be polygonal or elliptical.

The one surface "p" may include a seating recess 241*b* in which the light emitting module 230 is seated. The one surface "p" may also include a hole 241*a* through which a first wiring 250*a* passes. The first wiring 250*a* electrically connects the plurality of the light emitting modules 230 with the power controller 250. The hole 241*a* may be disposed at the center of the one surface "p".

The heat sink 240 may include an upper portion 241 and a lower portion 243. The upper portion 241 may have a cylindrical shape. The cylindrical upper portion 241 may have the one surface "p" on which the light emitting module 230 is disposed. The diameter of the cylindrical upper portion 241 increases the farther it is from the one surface "p". Therefore, the cylindrical upper portion 241 has the one surface "p" and a surface inclined toward the cylindrical lower portion 243 at an acute angle with respect to the one surface "p". The inclined surface of the cylindrical upper portion 241 facilitates a rear light distribution of the lighting device 200 according to the embodiment.

The lower portion 243 may have a cylindrical shape and extends from the cylindrical upper portion 241. The diameter of the cylindrical lower portion 243 decreases the closer it gets to the bottom thereof.

The area of the one surface "p" of the cylindrical upper portion 241 or the height of the cylindrical upper portion 241 may be changed according to the total volume of the light emitting module 230 or the entire length of the power controller 250.

A plurality of grooves 243*a* may be formed on the surface of the cylindrical lower portion 243 in the longitudinal direction of the cylindrical lower portion 243. The plurality of the grooves 243*a* may be radially disposed along the surface of the cylindrical lower portion 243. The grooves of the cylindrical lower portion 243 increase the surface area of the heat sink 240 to improve the heat radiation efficiency.

Although the plurality of the grooves 243*a* are formed only on the cylindrical lower portion 243 in the drawings, the plurality of the grooves may be also disposed on the surface of the cylindrical upper portion 241. For example, the plurality of the grooves 243*a* may be formed extending from the surface of the cylindrical lower portion 243 to the surface of the cylindrical upper portion 241.

The heat sink 240 is formed of a metallic material or a resin material which has excellent heat radiation efficiency. There is no limit to the material of the heat sink 240. For example, the material of the heat sink 140 can include at least one of Al, Ni, Cu, Ag and Sn.

Though not shown in the drawings, a heat radiating plate (not shown) may be disposed between the light emitting module 230 and the heat sink 240. The heat radiating plate (not shown) may be formed of a material having a high thermal conductivity such as a thermal conduction silicon pad or a thermal conduction tape and the like, and is able to effectively transfer heat generated by the light emitting module 230 to the heat sink 240.

<Power Controller>

The power controller 250 includes a support plate 251 and a plurality of parts 253 mounted on the support plate 251. The plurality of the parts 253 includes, for example, a DC converter converting. AC power supplied by an external power supply into DC power, a driving chip controlling the driving of the light emitting module 230, and an electrostatic discharge (ESD) protective device for protecting the light emitting module 230, and the like. However, there is no limit to the parts.

<Inner Case>

The inner case 260 may include an insertion portion 261 which is inserted into the receiving recess 240*a* of the heat sink 240, and a connection terminal 263 which is electrically connected to an external power supply.

The inner case 260 may be formed of a material having excellent insulation and durability, for example, a resin material.

The insertion portion 261 has a cylindrical shape with an empty interior. The insertion portion 261 is inserted into the receiving recess 240*a* of the heat sink 240 and prevents an electrical short-circuit between the power controller 250 and the heat sink 240. Therefore, a withstand voltage of the lighting device 200 can be improved.

The connection terminal 263 may be connected, for example, to an external power supply in the form of a socket. That is, the connection terminal 263 includes a first electrode 263*a* at the apex thereof, a second electrode 263*b* on the lateral surface thereof, and an insulating member 263*c* between the first electrode 263*a* and the second electrode 263*b*. Electric power is supplied to the first electrode 263*a* and the second electrode 263*b* from an external power supply. Here, since the shape of the connection terminal 263 is variously changed according to the design of the lighting device 200, there is no limit to the shape of the connection terminal 263.

<Mechanical and Electrical Connection Structure Between the Power Controller and the Inner Case>

The power controller 250 may be disposed in the receiving recess 240*a* of the heat sink 240.

The support plate 251 of the power controller 250 may be disposed perpendicularly with respect to one side of the substrate 231 such that air flows smoothly in the inner case 160. Accordingly, as compared with a case where the support plate 251 is disposed horizontally with respect to one side of the substrate 231, air flows up and down in the inner case 260 due to convection current, thereby improving the heat radiation efficiency of the lighting device 200.

Meanwhile, the support plate 251 may be disposed in the inner case 260 perpendicularly to the longitudinal direction of the inner case 260. There is no limit to how the support plate 251 is disposed.

The power controller 250 may be electrically connected to the light emitting module 230 through the first wiring 250*a* and may be electrically connected to the connection terminal 263 of the inner case 260 through a second wiring 260*a*. Specifically, the second wiring 260*a* is connected to the first electrode 263*a* and the second electrode 263*b* of the connection terminal 263, and then can be supplied an electric power from an external power supply. Also, the first wiring 250*a* passes through the hole 241*a* of the heat sink 140 and is able to electrically connect the power controller 250 with the light emitting module 230.

<Outer Case>

The outer case 270 surrounds the heat sink 240. Specifically, the outer case 270 surrounds a portion of the lateral surface of the heat sink 240.

The outer case 270 may be disposed separately from the lateral surface of the heat sink 240 at a predetermined interval. This intends to prevent heat from the heat sink 240 from being directly transferred to the outer case 270.

The outer case 270 allows a user to easily handle the lighting device 200 and prevents an electric shock and a burn accident due to the heat sink 240.

The outer case 270 may include a ring structure 271 coupled to the inner case 260, a cone-shaped body 273 having a central opening, and a connection portion 275 that physically connects the ring structure 271 with the body 273.

The body 273 has a cone shape. The body 273 has a shape corresponding to that of the cylindrical lower portion 243 of the heat radiating body 240. The body 273 may be disposed separately from the cylindrical lower portion 243 of the heat radiating body 240 at a predetermined interval.

The connection portion 275 may be comprised of a plurality of ribs. An opening "G2" is formed among the plurality of the ribs. The heat from the heat sink 240 may be radiated to the outside through the opening "G2".

The outer case 270 may be formed of a material having excellent insulation and durability, for example, a resin material.

Since the lighting device 200 has a structure capable of substituting for a conventional incandescent bulb, it is possible to use equipments for the conventional incandescent bulb without the use of a mechanical connection structure for a new lighting device or without the improvement of assembly.

Figure 14:
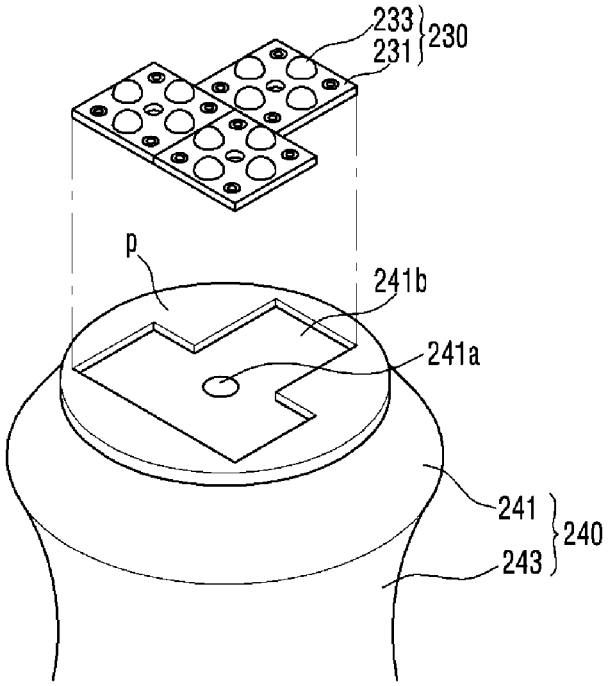
FIG. 14 is a view for describing the coupling of a heat sink and a light emitting module of the lighting device shown in FIG. 12.

FIG. 14 is a view for describing the coupling of a heat sink and a light emitting module of the lighting device shown in FIG. 12.

Referring to FIG. 14, the heat sink 240 includes a seating portion 241*b* which is formed on the one surface "p" of the cylindrical upper portion 241 and has a predetermined depth. The depth of the seating portion 241*b* may be the same as the thickness of the substrate 231. The outer circumference of the seating portion 241*b* may include at least one recess (not shown).

The seating portion 241*b* may have any shape corresponding to the shape of the substrate 231. An outer recess (not shown) formed in the outer circumference of the seating portion 241*b* may be disposed inward or outward with respect to the outer circumference of the seating portion 241*b*.

Specifically, when the outer recess (not shown) of the seating portion 241*b* of the heat sink 240 is formed outwardly with respect to the outer circumference of the seating portion 241*b*, the outer circumferential surface of the substrate 231 may include a protrusion portion (not shown) which is inserted and fixed into the outer recess (not shown) of the seating portion 241*b* of the heat sink 240.

When the outer recess (not shown) of the seating portion 241*b* of the heat sink 240 is formed inwardly with respect to the outer circumference of the seating portion 241*b*, the outer circumferential surface of the substrate 231 may include a recess corresponding to the seating portion 241*b* of the heat sink 240.

The coupling structure mentioned above prevents the substrate 231 from rotating or separating. Therefore, alignment characteristic between the heat sink 240 and the light emitting module 230 can be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting device comprising:

a heat sink which comprises one surface and a receiving recess;

a light emitting module which is disposed on the one surface of the heat sink and comprises a substrate and a plurality of light sources disposed on the substrate, wherein the substrate has a first hole disposed at the center thereof and a second hole;

a power controller which is electrically connected to the light emitting module through the second hole of the substrate and is disposed in the receiving recess of the heat sink, wherein the light emitting module comprises a first light emitting module comprising a first substrate and a first light source, and a second light emitting module comprising a second substrate and a second light source, wherein the first substrate and the second substrate are disposed adjacent to each other, and the first light source and the second light source are disposed adjacent to each other, and wherein a distance from the center of the first light source to the center of the first hole of the first substrate is substantially the same as a distance from the center of the first light source to the center of the second light source.

2. The lighting device of claim 1, wherein the plurality of the light sources are disposed symmetrically with each other with respect to the first hole of the substrate.

3. The lighting device of claim 1, wherein a plurality of the second holes of the substrate are provided, and wherein the plurality of the second holes of the substrate are disposed symmetrically with each other with respect to the first hole of the substrate.

4. The lighting device of claim 1, wherein distances from the end of the substrate to the ends of the plurality of the light source are the same as each other.

5. The lighting device of claim 1, wherein the second hole of the first substrate and the second hole of the second substrate are disposed adjacent to each other, and wherein the light emitting module comprises a connector electrically connected to the second hole of the first substrate and the second hole of the second substrate.

6. The lighting device of claim 1, wherein the one surface of the heat sink comprises a first seating recess in which the first light emitting module is disposed and a second seating recess in which the second light emitting module is disposed, and wherein the first seating recess and the second seating recess are partially connected with each other.

7. The lighting device of claim 1, wherein a lens covering the light source and including a resin and a fluorescent material, and wherein the fluorescent material includes at least two of a yellow fluorescent material, a green fluorescent material and/or a red fluorescent material.

8. The lighting device of claim 1, wherein the first and the second light emitting modules emit white light, and wherein the white light of the first light emitting module has a color temperature different from that of the white light of the second light emitting module.

9. A lighting device comprising:

a heat sink which comprises one surface and a receiving recess;

a light emitting module which is disposed on the one surface of the heat sink; and a power controller which electrically connected to the light emitting module and is disposed in the receiving recess of the heat sink, wherein the light emitting module comprises a first light emitting module and a second light emitting module, wherein the first and the second light emitting modules emit white light, wherein the white light of the first light emitting module has a color temperature different from that of the white light of the second light emitting module, wherein the one surface of the heat sink comprises a first seating recess in which the first light emitting module is disposed and a second seating recess in which the second light emitting module is disposed, and wherein the first seating recess and the second seating recess are partially connected with each other.

10. The lighting device of claim 9, wherein each of the first the second light emitting modules comprises a substrate and a plurality of light sources disposed on the substrate, and the substrate has a first hole disposed at the center thereof, wherein the substrate of the first light emitting module and the substrate of the second light emitting module are disposed adjacent to each other, wherein a distance from the center of a first light source among the light sources of the first light emitting module to the center of the first hole of the first light emitting module is the substantially same as a distance from the center of the first light source to the center of a second light source among the light sources of the second light emitting module, and wherein the first and second light sources adjacent to each other.

11. The lighting device of claim 10, wherein each of the substrates of the first and second light emitting module have a second hole, and wherein light emitting module comprises a connector which electrically connects the second holes of the first and second light emitting modules.

12. The lighting device of claim 10, wherein each of the substrates of the first and second light emitting module have a second hole, and wherein the power controller comprises an electrode pin which electrically connects the second holes of the first and second light emitting modules.

13. The lighting device of claim 12, further comprising an inner case which receives the power controller therein and is disposed in the receiving recess of the heat sink, and a holder which is coupled to the inner case in order to seal the power controller, wherein the holder comprises a protrusion portion having a hole allowing the electrode pin to pass through the hole.

14. The lighting device of claim 10, wherein a depth of the first seating recess is the same as the thickness of the substrate of the first light emitting module.

15. A lighting device comprising:

a heat sink which comprises one surface and a receiving recess;

a light emitting module which is disposed on the one surface of the heat sink; and a power controller which electrically connected to the light emitting module and is disposed in the receiving recess of the heat sink, wherein at least three light emitting modules are provided, wherein the at least three light emitting modules are disposed on the one surface of the heat sink in the shape of "T", and wherein the white light of the first light emitting module has a color temperature different from that of the white light of at least one of the second and the third light emitting modules.

16. The lighting device of claim 15, wherein the one surface of heat sink has a seating recess in which the at least three light emitting modules are disposed, and wherein the seating recess has a shape of "T".

17. The lighting device of claim 16, wherein each of the three light emitting modules comprises a substrate, and wherein a depth of the seating recess is the same as the thickness of the substrate.

18. The lighting device of claim 15, wherein the light emitting module comprises a connector which electrically connects two emitting modules among the three emitting modules.

19. The lighting device of claim 15, wherein the at least three light emitting modules comprise a first light emitting module, a second light emitting module and a third light emitting module, wherein each of the first light emitting module, the second light emitting module and the third light emitting module comprises a substrate and a plurality of light sources disposed on the substrate, and the substrate has a hole disposed at the center thereof, wherein the substrate of the second light emitting module are disposed adjacent to each other, wherein a distance from the center of a first light source among the light sources of the first light emitting module to the center of the hole of the first light emitting module is the substantially same as a distance from the center of the first light source to the center of a second light source among the light sources of the second light emitting module, and wherein the first and second light sources adjacent to each other.

20. The lighting device of claim 15, wherein the heat sink comprises an upper portion and a lower portion, and wherein the upper portion comprises both a first area having the one surface and a second area having a surface inclined with respect to the one surface.

* * * * *